United States Patent [19]

Goffe et al.

[11] 3,967,959

[45] July 6, 1976

[54] MIGRATION IMAGING SYSTEM

[75] Inventors: William L. Goffe, Webster; George A. Brown, Penfield, both of N.Y.

[73] Assignee: Xerox Corporation, Stamford, Conn.

[22] Filed: Dec. 13, 1973

[21] Appl. No.: 424,504

Related U.S. Application Data

[63] Continuation of Ser. No. 97,866, Dec. 14, 1970, abandoned, which is a continuation-in-part of Ser. No. 172, Jan. 2, 1970, abandoned.

[52] U.S. Cl. ..... 96/1 PS; 427/145; 427/161; 428/29; 346/74 ES; 346/74 J; 346/74 P; 96/1 R

[51] Int. Cl.[2] ..... G03G 13/00; G03G 13/22

[58] Field of Search ..... 96/1 R, 1 PS, 1 PE, 96/1 M, 1.3; 355/3 R; 427/145, 161; 428/29

[56] References Cited

UNITED STATES PATENTS

| | | | |
|---|---|---|---|
| 2,297,691 | 12/1942 | Carlson | 96/1 R |
| 2,860,048 | 11/1958 | Deubner | 96/1.5 |
| 3,140,174 | 7/1964 | Clark | 96/1.8 |
| 3,372,029 | 3/1968 | Nail | 96/1.8 X |
| 3,443,938 | 5/1969 | Bean et al. | 96/1.1 |
| 3,499,820 | 3/1970 | Desanlniers | 117/70 X |
| 3,510,419 | 5/1970 | Carreira | 96/1 PE |
| 3,556,781 | 1/1971 | Levy et al. | 96/1 R |
| 3,565,612 | 2/1971 | Clark | 96/1.3 |
| 3,616,395 | 10/1971 | Carreira | 96/1 PE |

*Primary Examiner*—Roland E. Martin, Jr.

[57] ABSTRACT

A migration imaging system wherein migration imaging members typically comprising a substrate, a layer of softenable material, and migration marking material, additionally contain one or more overlayers of material to produce improved results in the imaging system. The overlayer may variously comprise another layer of softenable material, a layer of material which is harder than the softenable material layer, or a gelatin layer.

16 Claims, 8 Drawing Figures

INVENTORS
WILLIAM L. GOFFE
GEORGE A. BROWN

BY

Roger W. Parkhurst
ATTORNEY

MIGRATION IMAGING SYSTEM

CROSS-REFERENCE TO RELATED APPLICATIONS

This is a continuation of application Ser. No. 97,866, filed Dec. 14, 1970 now abandoned, which is a continuation-in-part of application Ser. No. 172, filed Jan. 2, 1970, now abandoned.

BACKGROUND OF THE INVENTION

This invention relates in general to imaging, and more specifically to a migration imaging system employing overcoated migration imaging members.

Recently, a migration imaging system capable of producing high quality images of high density, continuous tone, and high resolution has been developed. Such migration imaging systems are disclosed in copending applications Ser. No. 837,780, filed June 30, 1969, and Ser. No. 837,591, filed June 30, 1969. In a typical embodiment of the new migration imaging system an imaging member comprising a substrate, a layer of softenable material and photosensitive marking material is latently imaged by electrically charging the member and exposing the charged member to a pattern of activating electromagnetic radiation such as light. Where the photosensitive marking material was originally in the form of a fracturable layer contiguous the upper surface of the softenable layer, the marking particles in the exposed areas of the member migrate toward the substrate when the member is developed by softening the softenable layer.

"Softenable" as used herein is intended to mean any material which can be rendered more permeable thereby enabling particles to migrate through its bulk. Conventionally, changing the permeability of such material or reducing its resistance to migration of migration marking material is accomplished by dissolving, melting, and softening, by methods, for example, such as contacting with heat, vapors, partial solvents, solvent vapors, solvents and combinations thereof, or by otherwise reducing the viscosity of the softenable material by any suitable means.

"Fracturable" layer or material as used herein, means any layer or material which is capable of breaking up during development, thereby permitting portions of said layer to migrate toward the substrate or to be otherwise removed. The fracturable layer may be particulate, semi-continuous, or microscopically discontinuous in various embodiments of the migration imaging members of the present invention. Such fracturable layers of marking material are typically contiguous the surface of the softenable layer spaced apart from the substrate, and such fracturable layers may be near, at, coated onto, or slightly, partially or substantially embedded in the softenable layer in the various embodiments of the imaging members of the inventive system. "Contiguous" for the purpose of this invention is defined as in Webster's *New Collegiate Dictionary*, Second Edition, 1960: "In actual contact; touching; also, near, though not in contact; adjoining," and is intended to generically describe the relationship of the fracturable layer of marking material in the softenable layer, vis-a-vis the surface of the softenable layer spaced apart from the substrate.

There are various other systems for forming such images, wherein non-photosensitive or inert, marking materials are arranged in the aforementioned fracturable layers, or dispersed throughout the softenable layer, as described in the aforementioned copending applications which also disclose a variety of methods which may be used to form latent images upon such migration imaging members.

Various means for developing the latent images in the novel migration imaging system may be used. These development methods include solvent wash-away; solvent vapor softening, heat softening, and combinations of these methods, as well as any other method which changes the resistance of the softenable material to the migration of particulate marking material through said softenable layer to allow imagewise migration of the particles toward the substrate. In the solvent wash-away development method, the migration marking material migrates in imagewise configuration toward the substrate through the softenable layer as it is softened and dissolved, leaving an image of migrated particles corresponding to the desired image pattern on the substrate, with the material of the softenable layer substantially completely washed away. In the heat or vapor softening developing modes, the softenable layer is softened to allow imagewise migration of marking material toward the substrate and the developed image member generally comprises the substrate having migrated marking particles near the softenable layer-substrate interface, with the softenable layer and unmigrated marking materials intact on the substrate in substantially their original condition.

Various methods and materials and combinations thereof have previously been used to fix unfixed migration images. For example, fixing methods and materials previously used are disclosed in copending applications Ser. No. 590,959, filed Oct. 31, 1966 now abandoned, and Ser. No. 695,214, filed Jan. 2, 1968.

In addition to the aforementioned copending applications, another copending application Ser. No. 71,781 filed Sept. 14, 1970, discloses a migration imaging system which relates to transparentizing background portions of an imaged member, apparently by an agglomeration effect. In that system an imaging member comprising a softenable layer containing a fracturable layer of electrically photosensitive migration marking material is imaged in one process mode by electrostatically charging the member, exposing the member to an imagewise pattern of activating electromagnetic radiation, and then softening the softenable layer by exposure for a few seconds to a solvent vapor thereby causing a selective migration of the migration material in the softenable layer in the areas which were previously exposed to the activating radiation. The vapor developed member is then subjected to a heating step causing the migration material in unexposed areas to agglomerate or flocculate, often accompanied by fusion of the marking material particles, thereby resulting in a very low background image. Alternatively, the migration image may be formed by heat followed by exposure to solvent vapors and a second heating step which results in background reduction. In this imaging system, the softenable layer remains substantially intact after development, with the image being self-fixed because the marking material particles are trapped within the softenable layer. In the embodiments thereof the final migration image having low background is typically formed by some combination of vapor-heat treatment.

In new and growing areas of technology such as the migration imaging systems of the present invention, new methods, apparatus, compositions of matter, and articles of manufacture continue to be discovered for the application of the new technology in new modes. The present invention relates to a new and advantageous migration imaging system employing overcoated imaging members.

SUMMARY OF THE INVENTION

It is, therefore, an object of this invention to provide a novel migration imaging system.

It is another object of this invention to provide novel migration imaging members.

It is another object of this invention to provide a novel migration imaging system wherein development is carried out substantially by heat.

It is another object of this invention to provide developed migration images having very low backgrounds.

It is another object of this invention to provide a more simple and more economical migration imaging system.

It is a further object of this invention to provide a novel migration imaging member and system wherein the imaging members are protected from external destructive forces such as abrasion, fingerprinting, dusting and the like, both before and after imaging.

It is still another object of this invention to provide an imaging system capable of producing opaque, translucent or even transparent imaged members, the latter resembling photographic film and microfilm in some embodiments.

The foregoing objects and others are accomplished in accordance with this invention wherein overcoated migration imaging members are used in conjunction with migration imaging systems.

BRIEF DESCRIPTION OF THE DRAWINGS

For a better understanding of the invention as well as other objects and further features thereof reference is made to the following detailed disclosure of the preferred embodiments of the invention taken in conjunction with the accompanying drawings thereof, wherein.

DESCRIPTION OF THE PREFERRED EMBODIMENTS

Figure 1:
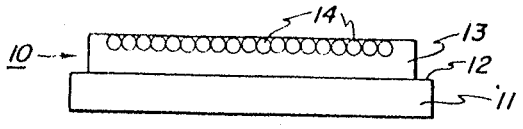
FIG. 1 shows a partially schematic, cross-sectional view of a typical layered configuration migration imaging member.
Figure 2:
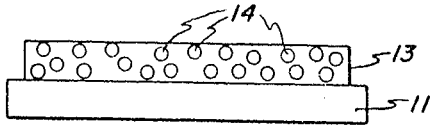
FIG. 2 shows a partially schematic, cross-sectional view of a typical binder-structured migration imaging member.

Migration imaging members typicaly suitable for use in the migration imaging processes described above and in the copending applications cited above, are illustrated in FIGS. 1 and 2. In the migration imaging member 10, illustrated in FIG. 1, the member comprises substrate 11 having a layer of softenable material

13 coated thereon, and the layer of softenable material 13 has a fracturable layer of migration marking material 14 contiguous the upper surface of softenable layer 13. In various embodiments, the supporting substrate 11 may be either electrically insulating or electrically conductive. Electrically insulating substrate materials will typically have resistivities of not less than about $10^{12}$ ohm-cm., and resistivities preferably not less than about $10^{14}$ ohm-cm. In some embodiments the electrically conductive substrate 11 may comprise a supporting substrate 11 having a conductive coating 12 coated onto the surface of the supporting substrate upon which the softenable layer 13 is also coated. The substrate 11 may be opaque, translucent, or transparent in various embodiments including embodiments wherein the electrically conductive layer 12 coated thereon may itself be partially or substantially transparent. The fracturable layer of marking material 14 contiguous the upper surface of softenable layer 13 may be coated onto, or slightly, partially, or substantially embedded in softenable material 13 at the upper surface of the softenable layer.

In FIG. 2 migration immaging member 10 also comprises supporting substrate 11 having softenable material layer 13 coated thereon. However, in this configuration the migration marking material 14 is dispersed throughout softenable layer 13 in a binder-structured configuration. As in the layered configuration embodiment illustrated in FIG 1, the substrate may be opaque, translucent, or transparent, electrically insulating or electrically conductive.

Copending applications in Ser. No. 837,780, filed June 30, 1969, and Ser. No. 837,591, filed June 30, 1969, describe migration imaging systems suitable for use in the present invention in great detail, and all the disclosure therein, and especially the disclosure relating to such imaging processes, imaging members and materials suitable for use in the migration imaging members used therein, is hereby expressly incorporated by reference in the present specification.

Figure 3:
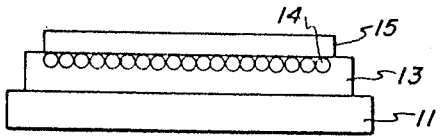
FIG. 3 shows a partially schematic, cross-sectional view of a preferred embodiment of the novel multi-layered or overcoated migration imaging member of this invention.

In FIG. 3 a preferred embodiment of the novel multilayered or overcoated structure of the present invention is shown wherein supporting substrate 11 has a layer of softenable material 13 coated thereon. In the embodiment illustrated in FIG. 3 the migration marking material 14 is initially arranged in a fracturable layer contiguous the upper surface of softenable material layer 13. However in other embodiments, the migration marking material 14 may be dispersed throughout softenable layer 13 as in the binder structured configuration illustrated in FIG. 2. In the preferred embodiment illustrated in FIG. 3 the migration imaging member also includes an advantageous overcoating layer 15 which is coated over softenable layer 13, or the fracturable layer of marking material 14 contiguous the upper surface of softenable layer 13. In various embodiments of this novel migration imaging member, the overcoating layer 15 may comprise another layer of softenable material, a hard protectve overlayer, a gelatin overlayer which gives particularly advantageous imaging results, or any other suitable overlayer material.

The materials suitable for use as substrates 11, softenable layers 13, and migration marking materials 14, are the same materials disclosed in the aforementioned copending applications which are incorporated by reference herein. As stated above, the substrate 11 may be opaque, translucent, transparent, electrically insulating or electrically conductive. Similarly, the substrate and the entire migration imaging member which it supports may be in any suitable form including a web, foil, laminate or the like, strip, sheet, coil, cylinder, drum, endless belt, endless mobius strip, circular disk or other shape. The present invention is particularly suitable for use in any of these configurations.

In various embodiments of the novel migration imaging members of the present invention, the migration marking material may be electrically photosensitive, photoconductive, photosensitively inert, magnetic, electrically conductive, electrically insulating, or any other combination of materials suitable for use in the migration imaging system.

In the advantageous system of the present invention, the migration marking material is also agglomerable material, and the term "agglomerable" and its variant forms herein refers to any material capable of agglomerating, flocculating or clustering and fusing with other particles or portions of the same material when processed in accordance with the present invention.

Materials particularly preferred as agglomerable migration marking materials because of their ability to function as both migration materials and agglomerable materials, include electrically photosensitive materials such as materials comprising selenium, including amorphous selenium, crystalline selenium, selenium-tellurium alloys, arsenic triselenide, and tellurium, sulfur, and others. Other agglomerable migration marking materials which are not necessarily electrically photosensitive materials include gallium, cobalt tricarbonyl thermoplastics or dyed thermoplastics such as polyoctyl acrylate, polylauryl methacrylate; dyed waxes; dyed paraffins and others. Such materials may be dyed with any suitable material, such as phthalocyanine dyes, fluorescein dyes or any other dye colorant; a whole host of materials suitable for use as such dyes is set forth in U.S. Pat. No. 3,384,488. In addition, the migration marking particles may comprise a particle matrix comprising an agglomerable material which includes smaller pigment particles. For example, the thermoplastic materials listed above are particularly suitable for such large particle matrices, which any suitable pigment such as zinc oxide, titanium dioxide, lead oxide, phthalocyanine pigments, or any other suitable marking pigment may be used as the pigment particles in the agglomerable migration material matrix. It has been found that the agglomerable migration materials of the present invention preferably have low glass transition temperatures so that they may agglomerate, fuse and coalesce more readily than any effects of the process steps on the materials comprising the softenable layer in the advantageous sytem of the present invention become noticeable. Where the preferred charge-expose mode of latent imaging is used, such materials also preferably have high absorption co-efficients in the visible spectral ranges of the activating electromagnetic radiation.

These agglomerable migration marking materials are contained in the softenable layer in fracturable layers or in dispersed particulate form in such particle sizes and particle spacing conditions that when the softenable layer is softened by any suitable means, such as by heating or by contacting with solvent vapors, and the member is further heated, and that the particles or adjacent portions of the migration marking materials are capable of agglomerating or flocculating together and fusing into a single mass. The agglomerable mass of marking material typically has a lesser total cross-sectional area (in the plane of the surface of the imaging member) than the total cross-sectional area of the material as orginally dispersed, and this decrease in area gives lower background density, thereby enhancing the contrast in images treated by the advantageous process of the present invention. As disclosed in the incorporated disclosures, particles of the migration marking material suitable for use in the present invention are preferably of average size not greater than about two microns. Submicron particles give an even more satisfactory result, with an optimum range of particle size comprising particles of average size not greater than about 0.7 microns. When the migration marking material is arranged in a fracturable layer contiguous the surface of the softenable material spaced apart from the substrate, such fracturable layers are preferably of thicknesses in the range between about 0.01 to 2.0 microns, although fracturable layers of thicknesses of about 5 microns have been found to give good results in various embodiments.

Where portions of such agglomerable migration marking materials or particles are to be processed by the inventive system (in either image or background or migrated or unmigrated areas) to cause agglomeration and/or fusing, it is preferable that such particles or portions of the agglomerable material have particle-to-particle spacings of not greater than about ½ microns, although in some embodiments, layer particle-to-particle spacings are suitable. Such particle-to-particle spacings facilitate the agglomeration and flocculation of the marking materials.

The softenable material 13 may be any suitable material which may be softened by liquid solvents, solvent vapors, heat, or combinations thereof. In addition, in many embodiments of the migration imaging member, the softenable material 13 is typically substantially electrically insulating and does not chemically react during the migration force applying and developing steps of the advantageous system of the present invention. It should be noted that layer 11 should preferably be substantially electrically insulating for the preferred modes hereof of applying electrical migration forces to the migration layer but more conductive materials may be used because of the increased capability in the electrical mode hereof of applying a constant and replenishing supply of charges in image configuration. Although the softenable layer has been described as coated on a substrate, in some embodiments the softenable layer may itself have sufficient strength and integrity to be substantially self-supporting, and may be brought into contact with a suitable substrate during the imaging process.

Where the advantageous overlayer 15 comprises a softenable material similar to the material of layer 13, the overlayer may include materials in the classes of polystyrenes, alkyd substituted polystyrenes, polyolefins, styrene-acrylate copolymers, styrene-olefin copolymers, silicone resins phenolic resins, amorphous glasses and others. Such materials more particularly include Staybelite Ester 10, a partially hydrogenated rosin ester, Foral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyrene-olefin copolymer from Velsicol Chemical Corp,; Hydrogenated Piccopale 100, Piccopale H-2, highly branched polyolefins, Piccotex 100, a styrene-vinyl toluene copolymer, Piccolastic A-75, 100 and 125, all polystyrenes, Piccodiene 2215, a polystyrene-olefin copolymer, all from Pennsylvania Industrial Chemical Corp.; Araldite 6060 and 6071, epoxy resins from Ciba; Amoco 18, a polyalpha-methylstyrene from Amoco Chemical Corp.; R5061A, a phenylmethyl silicone resin and M-140, a custom synthesized styrene-co-n-butylmethacrylate, from Dow Corning; Epon 1001, a bisphenol A-epichlohydrin epoxy resin, from Shell Chemical Corp.; and PS-2, PS-3, both polystyrenes, and ET-693, and Amberol ST, phenol-formaldehyde resins; ethyl cellulose, and Dow C4, a methylphenylsilicone, all from Dow Chemical; a custom synthesized 80/20 mole per cent copolymer of styrene and hexylmethacrylate having an intrinsic viscosity of 0.179 dl/gm; other copolymers of styrene and hexylmethacrylate, a custom synthesized polydiphenylsiloxane; a custom synthesized polyadipate; acrylic resins available under the trademark Acryloid from Rohm & Haas Co., and available under the trademark Lucite from the E.I. duPont de Nemours & Co.; thermoplastic resins available under the trademark Pliolite from the Goodyear Tire & Rubber Co.; a chlorinated hydrocarbon available under the trademark Aroclor from Monsanto Chemical Co.; thermoplastic polyvinyl resins available under the trademark Vinylite from Union Carbide Co.; other thermoplastics disclosed in Gunther et al U.S. Pat. No. 3,196,011; other materials disclosed in copending application Ser. No. 27,890, filed Apr. 13, 1970; waxes and blends, mixtures and copolymers thereof. The above group of materials is not intended to be limiting, but merely illustrative of materials suitable for such softenable overlayers.

The above list of softenable materials suitable for overlayer 15 generally includes materials also suitable for softenable layer 13. However, in various embodiments the overlayer 15 and softenable layer 13 need not comprise the same material. In various embodiments advantageous overlayer 15 may itself be substantially electrically insulating, electrically conductive; photosensitive, photoconductive, photosensitively inert, or have any other desired properties. For example, where the overlayer is photoconductive, it may be used to impart light sensitivity to the imaging member through the techniques of xerographic technology. The overlayer may also be transparent, translucent or opaque depending upon the imaging system in which the overcoated member is desired for use. Where the overlayer comprises substantially electrically insulating softenable materials, it will typically have resistivities not less than about $10^{10}$ ohm-cm., and preferably have resistivities of not less than about $10^{12}$ ohm-cm. Advantageous overlayer 15 is typically preferably of a thickness up to about 75 microns, although thicker overlayers may be suitable and desirable in certain embodiments. For example if the overlayer is electrically conductive there are virtually no limitations except for the practical ones of handling and economics. Where the overlayer is greater than about 75 microns thick, undesirably high potentials may have a greater tendency to build up on the imaging member during processing in migration imaging systems.

Where the advantageous overlayer 15 comprises material which is typically harder than the softenable material typically used in layer 13, the overlayer may include materials such as Bavick 11, a copolymer of alpha methyl styrene and methyl methacrylate; Mylar, a polyester resin available from DuPont; Elvacet, a polyvinyl acetate resin available from DuPont; and others as well as mixtures and copolymers thereof.

These harder overcoatings are particularly advantageous for the purpose of protecting the migration imaging members of the present invention from external destructive forces such as abrasion, fingerprinting, dusting, and the like. It will be appreciated that these advantageous overcoatings protect the migration imaging members before imaging, during imaging and after the members have been imaged to contain the desired migration image. These overcoatings are typically preferably not greater than about 75 microns thick if they are substantially electrically insulating. Conductive overcoatings may typically be as thick as desired.

These harder overcoatings, unlike the softenable material overcoatings described above, are typically not preferred for use in softenable layer 13. However, the harder overcoatings typically permit charge transport through the overlayer 15 (at least during development of the latent image on the member), transfer of the charge to the imaging particles 14, subsequent migration of the marking particles 14 in the suitably softened underlayer 13, and possess various other properties which allow the migration imaging process of the present invention to be performed satisfactorily.

These harder overcoatings will typically not appreciably soften when the migration imaging members are developed by the application of heat sufficient to soften the softenable layer 13. However in various embodiments, it may be advantageous to use harder overlayer materials which, while not preferred as materials for softenable layer 13, may soften with increased application of heat or solvent vapors; may permit solvent vapor to penetrate to the softenable layer; may allow charge migration before or during heating or exposure to solvent vapor; may permit removal of the overlayer by stripping or solvent flushing without effecting the underlying imaging structure; or may be suitable for use as substrates where the overlayered migration imaging member is split to produce complementary images, for example, as described in copending application Ser. No. 784,164, filed Dec. 16, 1968.

In still other embodiments, the advantageous overlayer 15 may comprise a suitable layer of gelatin. Such gelatin layers have been found to be particularly advantageous in a preferred embodiment of the novel migration imaging system of the present invention. Any suitable grade of gelatin may comprise overlayer 15 in this embodiment. For example, typical grades are edible, photographic, technical, and U.S.P. XVII. These gelatins are generally colorless; transparent; odorless; tasteless; absorb up to five to ten times their weight of water; are soluble in hot water, glycerol and acetic acid; and insoluble in alcohol, chloroform, and other organic solvents. These gelatins are commonly used in the manufacture of photographic films; lithography; sizing; plastic compounds; textile and paper work; foods; rubber substitutes; adhesives; cements; capsules for medicinals; artificial silk; matches; light filters; clarifying agents; bacteriology; and medicine.

Due to their desirable film forming characteristics and chemical composition, photographic grade gelatins are preferred grades of gelatins for use in the instant invention. These gelatins comprise any naturally occurring protein used as the binding medium for silver halide crystals in the common type of photographic emulsions, and are not limited to any particular definite chemical compound. A given sample of gelatin may contain molecules of various molecular weights ranging from about 20,000 to over 100,000, and of various amino-acid compositions. The gelatin coating is normally dissolved in water and coated over the surface of the softenable layer 13 which contains the migration marking particles. A more inclusive definition for gelatin compounds falling within the scope of this invention is set forth under the definition of "gelatin" contained in the *Focal Encyclopedia of Photography*, Vol. 1, Focal Press, London and New York, 1965, pp. 695 and 696.

The thickness of the gelatin layer generally should range from about 0.01 to 1.0 microns. A preferred range of thickness which yields outstanding results is from about 0.1 to 0.5 microns. The thin gelatin layer may be applied by any suitable technique.

The advantageous imaging members of the present invention described above, are useful in the novel imaging systems described in conjunction with FIG. 4. The imaging steps in the advantageous processes using the novel imaging members of the present invention typically comprise the steps of forming an electrical latent image upon the imaging member, and developing the latently imaged member by decreasing the resistance of the softenable material to the migration of the particulate marking material through the softenable layer 13 whereby migration marking material is allowed to migrate in depth in softenable material layer 13 in an imagewise configuration. The imaging members illustrated in FIG. 4 are the layered configuration imaging members like that illustrated in FIG. 3. However, binder structured imaging members such as illustrated in FIG. 2 and as described in conjunction with FIG. 3 may also be used in the advantageous imaging systems of the present invention as described in FIG. 4.

Figure 4A:
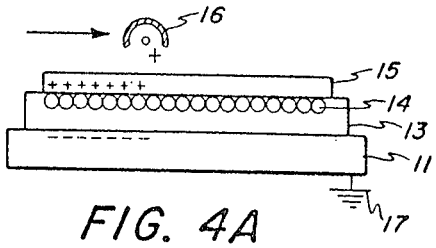
FIG. 4A–4D illustrates in partially schematic, cross-sectional views, the process steps in preferred embodiments of the advantageous system of the present invention.
Figure 4B:
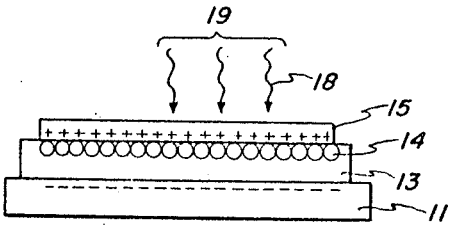

Any method for forming an electrical latent image upon the imaging member may typically be used in the advantageous process of the present invention. For example, the surface of the imaging member may be electrically charged in imagewise configuration by various modes including charging or sensitizing an image configuration through the use of a mask or stencil, or by first forming such a charge pattern on a separate layer such as a photoconductive insulator layer used in conventional xerographic reproduction techniques, and then transferring this charge pattern to the surface of a migration imaging plate by bringing the two into very close proximity and utilizing break-down techniques as described for example in Carlson U.S. Pat. No. 2,982,647, and Walkup U.S. Pat. Nos. 2,825,814 and 2,937,943. In addition, charge patterns conforming to selected shaped electrodes or combinations of electrodes may be formed on a support surface by the TESI discharge technique, as more fully described in Schwertz U.S. Pat. Nos. 3,023,731 and 2,919,967, or by techniques described in Walkup U.S. Pat. Nos. 3,001,848 and 3,001,849, or by induction imaging techniques, or even by electron beam recording techniques, as described in Glenn U.S. Pat. No. 3,113,179.

Where the migration marking material or the softenable material is electrically photosensitive material, the electrical latent image may be formed on the imaging member by electrostatically charging the member and then exposing the charged member to activating electromagentic radiation in an imagewise pattern. This is the method illustrated in FIG. 4A and 4B. In FIG. 4A the advantageous imaging member of the present invention comprising substrate 11 having softenable layer 13 thereon with fracturable layer of marking material 14 contiguous the surface of the softenable layer 13, and advantageous overcoating 15 thereon, is shown being electrostatically charged with corona charging device 16. Where substrate 11 is conductive, the charging step is enhanced by grounding the conductive substrate as shown at 17. Similarly, where the substrate 11 is electrically insulating, the electrically insulating substrate may be placed on a grounded conductive backing to enhance the charging step. Still another method of electrically charging such a member is to electrostatically charge both sides of the member to surface potentials of opposite polarity. In FIG. 4B the charged member is shown being exposed to activating electromagnetic radiation 18 in area 19, thereby forming an electrical latent image upon the imaging member.

Figure 4C:
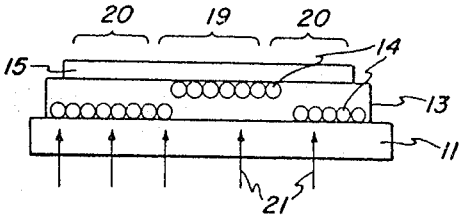

The member having the electrical latent image thereon is then developed by decreasing the resistance of the softenable material to migration of the particulate marking material through the softenable layer 13, here for example as shown in FIG. 4C by softening by the application of heat shown radiating into the softenable material at 21. The application of heat, solvent vapors, or combinations thereof, or any other means for decreasing the resistance of the softenable material of softenable layer 13 to migration of the migration marking material may be used to develop the laterally imaged member, whereby migration marking material 14 is allowed to migrate in depth in softenable layer 13 in imagewise configuration. In FIG. 4C the migration marking material is shown migrated in areas 20, and in its initial, unmigrated state in area 19. It is seen that areas 19 and 20 correspond to the formation of the electrical latent image described in conjunction with FIGS. 4A and 4B.

Depending upon the specific imaging system used, including the specific imaging structure, material, process steps, and other parameters, the advantageous imaging system of the present invention may produce positive images from positive originals or negative originals from positive originals.

The migrated, imaged member illustrated in FIG. 4C is shown with the protective layer 15 thereon. It is seen that this layer 15 protects the imaging member before, during, and after imaging.

Where the advantageous imaging member of the present invention described in FIG. 3 wherein the advantageous overlayer 15 is a gelatin as described above, is used, the imaging process of the present invention as described in conjunction with FIG. 4 produces still other surprising and advantageous results. Particularly advantageous results are achieved when the migration marking maeterial is initially oriented in the fracturable layer contiguous the upper surface of softenable material layer 13. In this process the imaging steps may be carried out as described in FIGS. 4A, 4B, and 4C. However, it is particularly noticeable in the advantageous system of this invention that the migration marking material 14 in area 19 as shown in FIG. 4C remains substantially exactly in its initial unimaged position. Surprisingly it has been found that the presence of gelatin overlayer 15 helps to maintain the unmigrated marking material 14 in area 19 in this initial position.

In the development step illustrated in FIG. 4C, the imaging member is typically developed by uniformly heating the structure to a relatively low temperature. This temperature is generally within the range between about 60°to about 130°C. and the heat is applied for only a few seconds. When the heat is applied, the softenable material layer 13 decreases in viscosity, thereby decreasing its resistance to migration of the marking material through the softenable layer, and the marking material is permitted to migrate in depth in the softenable layer 13, and is here shown migrating in the unexposed areas 20.

Figure 4D:
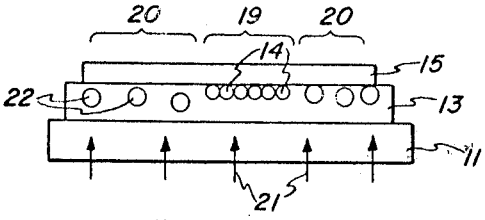

In addition to marking material particle migration, under some conditions an advantageous fusing or agglomeration effect, illustrated in FIG. 4D, may occur whereby migrated marking particles fuse or agglomerate to form larger particles 22 which typically are migrated away from the gelatin layer-softenable layer interface. As before, it is noted that the particles which have been exposed to light in areas 19 did not fuse or agglomerate, and are maintained in essentially their initial unmigrated position contiguous the surface of the softenable material 13. This last effect is aided by advantageous overlayer 15 as discussed above.

The image formed by the development steps illustrated in FIG. 4 results in a higher quality light absorbing image because of the agglomeration or selective fusing of the migration marking material. This image has a lower background than images obtained by using the same structure without the gelatin ovrcoating. This imaging process is further believed to be novel in that contrary to the usual migration imaging process set forth in copending application Ser. No. 71,781 filed Sept. 14, 1970 (the entire disclosure of which is hereby expressly incorporated by reference in the present specification), only those particles which have migrated away from the gelatin layer-softenable layer interface, fuse together. Therefore, it is seen that the novel imaging structure and process of the present invention offers a new approach to obtain more fully heat or vapor softened, developed migration imaging films which have low background images. At the same time, this film also provides enhanced protective characteristics such as lower tack and greater resistance to abrasion, before, during and after image formation.

Furthermore, the system of the present invention puts less critical demands on the migration process in that the migration marking particles need only leave the immediate vicinity of the gelatin layer-softenable layer interface to achieve a higher contrast image. The migration imaging systems clearly disclosed in the above mentioned copending applications typically operate with more extensive migration wherein the migration marking materials migrate relatively considerably in depth in the softenable material layer.

Figure 5:
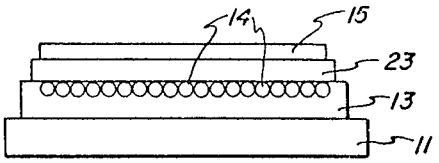
FIG. 5 shows a partially schematic, cross-sectional view of another preferred embodiment of the novel multi-layered or overcoated migration imaging member of the present invention.

Still another embodiment in the advantageous system of the present invention is described in FIG. 5 wherein the migration imaging member is overlayed with two separate layers of protective material. The member illustrated in FIG. 5 comprises substrate 11, softenable material 13 and migration marking material 14 having an intermediate protective layer 23 coated onto the softenable material 13 between the softenable material and protective layer 15. It has been found particularly advantageous to use imaging members in this configuration wherein the intermediate protective layer 23 comprises a gelatin such as those described above herein, and protective layer 15 comprises the hard-type coatings which are also described above herein.

The following examples further specifically define the present invention wherein overcoated migration imaging members are used in conjunction with novel migration imaging systems. The parts and percentages are by weight unless otherwise indicated. The examples below are intended to illustrate various preferred embodiments of the novel migration imaging system.

EXAMPLE I

An imaging member or film such as that illustrated in FIG. 3 is prepared by first making a mixture of about 20% by weight of hydrogenated Piccopale 100 (HP-100), a highly branched polyolefin, available from the Pennsylvania Industrial Chemical Co., dissolved in a solution of toluene. Using a gravure roller, the mixture is then roll coated onto an about 3 mil aluminized Mylar polyester film (E.I. duPont de Nemours Co., Inc.) having a thin, semi-transparent aluminum coating. The coating is applied so that when air dried for about 2 hours to allow for evaporation of the toluene, an imaging plate comprising about a two micron layer of HP-100 is formed on the aluminized Mylar. A thin layer of particulate vitreous selenium approximately 0.5 microns in thickness is then deposited onto the Staybelite surface by inert gas deposition utilizing the process set forth in copending patent application Ser. No. 423,167, filed on Jan. 4, 1965 An about 0.5 micron coating of photographic grade gelatin available from the American Agricultural Chemical Co. under the 1965. Keystone Gelatin is then applied over the selenium layer by dip coating from a 1% solution by volume of gelatin in water, and allowing the coating to dry resulting in a gelatin overlayer about 0.5 microns thick.

EXAMPLE II

An imaging member or film is formed by the method of Example I in which the HP-100 is replaced with an about 20% mixture of an about 80/20 mole per cent copolymer, called P-37, of styrene and hexylmethacrylate, dissolved in toluene. About 10 grams of Keystone gelatin powder is dissolved in about 100 cc. of water, and this gelatin solution coated onto the surface of th bare imaging film with a No. 5 draw rod. This structure is then dried in an oven at about 50°C. for about 1 hour. The resultant member comprises a thin, particulate vitreous selenium layer approximately 0.5 microns in thickness deposited at the upper surface of the softenable plastic layer P-37 which is contained on an about 3 mil aluminized Mylar substrate, and this member is overcoated with a layer of gelatin of about 0.5 microns in thickness.

EXAMPLE III

The gelatin overcoated imaging structure provided by Example II is further overcoated by applying a solution of about 10% Bavick II, a copolymer of alpha methylstyrene and methyl methacrylate from J. T. Baker Co., in toluene solvent, with a No. 7 draw rod. This Bavick coating is placed directly over the gelatin coating.

EXAMPLE IV

An uncoated imaging member is provided as described in Example I. A solution of about 10% Bavick II in toluene solvent is coated with a No. 7 draw rod onto another film of Mylar which has been previously coated with zinc stearate (a release agent). The Bavick coated Mylar is then laminated to the uncoated imaging structure by placing them face-to-face together and passing this Mylar sandwiched imaging member between a pair of hot rollers at temperatures in the range of about 70° to 80°C. This type of overcoated member is suitable for stripping or splitting typically after imaging such a member.

EXAMPLE V

An uncoated imaging structure is provided as described in Example I. A coating solution of Elvacite, an acrylic resin available from Dupont, is dissolved in n-propanol, and this solution is coated to a thickness of about 2 microns onto the uncoated imaging structure with a No. 7 draw rod. This coated structure is then allowed to air dry at room temperature.

EXAMPLE VI

An uncoated imaging structure is provided as described in Example I. An about 10% solution of Piccopale H-2, a cyclic hydrocarbon resin produced by polymerizations of unsaturates derived from deep cracking of petroleum, available from Pennsylvania Industrial Chemical Corp., is prepared in octane solvent, and an about ½ micron layer of this solution is coated onto the uncoated imaging structure with a No. 5 wire wound draw rod and allowed to dry. A solution of Bavick in acetone is then coated over the H-2 coating with a No. 10 draw rod. This structure is then baked for about 1 hour at about 65°C. The H-2 interlayer prevents solvents in which the Bavick overlayer is prepared from affecting the underlying imaging member.

EXAMPLE VII

An uncoated imaging structure is provided as described in Example I. A protective film of Mylar about 19 microns thick is laminated to the uncoated imaging structure by placing the Mylar film on the surface of the uncoated member and by passing this Mylar sandwiched structure between a pair of heated rollers at temperatures in he range between about 70°C. and about 80°C.

EXAMPLE VIII

An uncoated imaging structure is provided as described in Example II. A protective overcoating of Saran, poly-vinylidene chloride, about 10 microns in thickness is coated over the uncoated imaging structure. This is done by simply laying the Saran film upon the surface of the uncoated member without a lamination step, or, alternatively, the Saran layer is laminated to the uncoated imaging member by passing the sandwiched member between a pair of hot rollers at about 65°C.

EXAMPLE IX

An uncoated imaging structure is provided as described in Example II wherein P-37 is the softenable layer. A water solution of polyvinyl methyl ether is prepared and wipe coated onto the surface of the uncoated imaging member. This overcoating dries at room temperature for about ½ hour leaving an about 1 micron thick overcoating on the imaging member.

EXAMPLE X

An uncoated imaging structure is provided as described in Example II with P-37 as the softenable layer. A solution of usually crystalline polyester polyxylene sebacate in chloroform is dip coated onto a film of aluminized Mylar and allowed to dry for about 1 hour at room temperature. The coated aluminized Mylar and the uncoated imaging structure are then placed face-to-face in a sandwich configuration and laminated by passing the sandwich structure through a pair of hot rollers at about 65°C. This member may be stripped or split.

EXAMPLE XI

The film made by the method of Example I is imaged as follows: The film is charged under dark room conditions to a positive potential of about 200 volts by a corona charging device such as that disclosed in U.S. Pat. No. 2,588,699 to Carlson. The plate is then exposed to a light source of about 5 foot-candle-seconds, and then heated to a temperature of about 100°C. for about 2 seconds. This procedure results in a formation of a positive to negative image formed by the fusion of the selenium particles in the non-exposed areas.

EXAMPLE XII

A sample of the imaging film of Example II is imaged as follows: The film is charged to a retained negative potential of about 120 volts. The charged film is then exposed to a pattern of light equal to about 2.5 foot-candle-seconds. The film is then heated to a temperature of about 100°C. for about 2 seconds resulting in the formation of a positive to positive image.

EXAMPLES XIV – XVIII

Structures used: Examples III–VII
Charging: negative from 10 to 40 volts/micron with higher fields preferred
Exposure $1 \times 10^{12}$ photons/cm$^2$ of $4000^4$ light
Development: on a hot plate at 110°C. for one minute or at 118°C. for a few seconds.
Result: partial migration in the exposed areas. Exposed areas appear light blue while unexposed areas have original red-orange color. Image is the same as if there had been no overlayer.

EXAMPLE XIX

Structure used: Example VIII
Charging: −200 to −600 volts with −600 volts preferred
Exposure: $1 \times 10^{12}$ photons/cm$^2$ of $4000^4$ light
Development: on a hot plate at 110°C. for 1 minute or 118°C. for a few seconds.
Result: as in Examples XIV –XVIII

EXAMPLE XX

As in Example XIX except additional step of stripping away Mylar while on the hot plate.
Result: Two images. Positive to negative on the original film base and positive to positive on the Mylar base.

EXAMPLE XXI

Structure Used: Example IX
Charging: −60 to −160 volts
Exposure: $1 \times 10^{12}$ photons/cm$^2$ of 4000A light
Development: Hot plate for 5 seconds at 110°C.
Result: as in Examples XIV–XVIII

EXAMPLE XXII

Structure used: Example X
Charging: −60 to −300 volts
Exposure: as in Example XXI
Development: as in Example XXI
Result: as in Examples XIV –XVIII

EXAMPLE XXIII

Structure used: Example XI
Charging: −160 volts
Exposure: as in Example XXI
Development: as in Example XXI
Result: as in Examples XIV –XVIII

EXAMPLE XXIV

Structure used: Example IX
Charging: +100 to +400 volts
Exposure: as in Example XXI
Development: as in Example XXI
Result: as in Examples XIV–XVIII

EXAMPLE XXV

Structure used: Example X
Charging: +120 to +200 volts
Exposure: as in Example XXI
Development: as in Example XXI
Result: as in Examples XIV–XVIII

EXAMPLE XXVI

Structure used: Example XI
Charging: +160 volts
Exposure: as in Example XXI
Result: as in Examples XIV–XVIII

EXAMPLE XXVII

Structure used: Example VIII
Charging: +700 to +1300 volts
Exposure: as in Example XXI
Development: as in Example XXI
Result: Partial migration in the unexposed area and no migration in the exposed area

EXAMPLE XXVIII

Structure used: Example III
Charging: +140 to +260 volts
Exposure: as in Example XXI
Development: as in Example XXI
Result: as in Example XXVII

EXAMPLE XXIX

Same as Example XXVIII except higher temperature (at 120°C.).

Result: Se particles fuse in unexposed areas (partially migrated areas) producing remarkable increase in transparency in these areas.

EXAMPLE XXX

An imaging member is prepared by overcoating aluminized Mylar with an about 2 micron layer of P-37 softenable material, and powdered graphite is cascaded over the surface of the softenable layer thereby forming a fracturable layer of graphite at the surface of the softenable layer. This member is overcoated with an about 19 micron layer of Mylar as in Example VIII This overcoated imaging member is imagewise charged by electrostatically charging through a stencil mask, and is then heated for about 20 seconds at about 110°C. to soften the softenable material thereby allowing the graphite particles to migrate toward the substrate in the imagewise charged areas.

EXAMPLE XXXI

An imaging member is prepared by dispersing graphite particles throughout a P-37 solution before coating upon an aluminized Mylar substrate. This binder layer having graphite dispersed throughout the P-37 softenable layer is then overcoated with an about 19 micron layer of Mylar as described in Example VIII. This imaging member is charged and developed as in Example XXX.

Although specific components and proportions have been stated in the above description of the preferred embodiments of the novel migration imaging system wherein overcoated migration imaging members are used, other suitable materials and variations in the various steps in the system as listed herein, may be used with satisfactory results and various steps in the system as listed herein, may be used with satisfactory results and various degrees of quality. In addition, other materials and steps may be added to those used herein and variations may be made in the process to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principal and scope of this invention.

What is claimed is:

1. An imaging process comprising:

providing an imaging member comprising a substrate, a layer of substantially electrically insulating softenable material containing agglomerable migration marking marking material comprising a fracturable layer of said agglomerable migration marking material, said softenable layer capable of having its resistance to migration of agglomerable migration marking material decreased sufficiently to allow migration of agglomerable migration marking material in depth in said softenable layer, a layer of gelatin overlying said softenable layer and said fracturable layer of said agglomerable migration marking material contacting said gelatin layer-softenable layer interface;

forming an electrical latent image on said imaging member; and developing said imaging member by decreasing the resistance to migration of agglomerable migration marking material in depth in the softenable layer at least sufficient to allow imagewise migration of agglomerable migration marking material in depth in the softenable layer.

2. The imaging process of claim 1 wherein said member is developed by heating sufficiently to decrease the resistance of the softenable material to migration of agglomerable migration marking material.

3. The imaging process of claim 2 wherein the heat development is continued to a temperature sufficient to agglomerate the migrated agglomerable migration marking material whereby the migrated agglomerable migration marking material agglomerates and/or fuses, while the unmigrated agglomerable migration marking material remains substantially intact in its initial position contacting the gelatin layer-softenable layer interface.

4. The imaging process of claim 3 wherein the imaging member is provided with a second substantially transparent overlayer of material overlying the layer of gelatin.

5. The imaging process according to claim 3 wherein the layer of gelatin comprises a layer with a thickness of from about 0.01 to about 1.0 microns of photographic grade gelatin with a molecular weight ranging from about 20,000 to about 100,000.

6. An imaging process comprising:

providing an imaging member comprising a substrate, a layer of substantially electrically insulating softenable material containing electrically photosensitive agglomerable migration marking material comprising a fracturable layer of said material, said softenable layer capable of having its resistance to migration of agglomerable migration marking material decreased sufficiently to allow migration of migration material in depth in said softenable layer, a layer of gelatin on the softenable layer, said fracturable layer of said agglomerable migration marking material contacting said gelatin layer - softenable layer interface.

electrically charging said imaging member;

exposing said member to an image pattern of activating electromagnetic radiation whereby an electrical latent image is formed thereon; and developing said imaging member by decreasing the resistance to migration of agglomerable migration marking marking material in depth in the softenable layer at least sufficient to allow imagewise migration of agglomerable migration marking material at least in depth in said softenable layer.

7. The imaging process of claim 6 wherein said member is developed by heating sufficiently to decrease the resistance of the softenable material to migration of agglomerable migration marking material.

8. The imaging process of claim 7 wherein the heat development is continued to a temperature sufficient to agglomerate the migrated agglomerable migration marking material whereby the migrated agglomerable migration marking material agglomerates and/or fuses, while the unmigrated agglomerable migration marking material remains substantially intact in its initial position contacting the gelatin layer - softenable layer interface.

9. The imaging process of Claim 8 wherein the electrically photosensitive material comprises vitreous selenium.

10. The imaging process of claim 8 wherein the layer of gelatin comprises a layer with a thickness of from about 0.01 to about 1.0 microns of photographic grade gelatin with a molecular weight ranging from about 20,000 to about 100,000.

11. The imaging process of claim 9 wherein the imaging member is provided with a second substantially transparent overlayer of material overlying the layer of gelatin.

12. An imaging process comprising:

providing an imaging member comprising a substrate, a layer of softenable material containing agglomerable migration marking material comprising a fracturable layer of said agglomerable migration marking material, said softenable layer capable of having its resistance to migration of agglomerable migration marking material decreased sufficiently to allow migration of agglomerable migration marking material in depth in said softenable layer, a layer of gelatin overlying the softenable layer, and said fracturable layer of said agglomerable migration marking material contacting said gelatin layer-softenable layer interface;

forming an electrical latent image on said imaging member; and developing said imaging member by decreasing the resistance to migration of agglomerable migration marking material in depth in the softenable layer at least sufficient to allow imagewise migration of agglomerable migration marking material at least in depth in said softenable layer.

13. The imaging process of claim 12 wherein said member is developed by heating sufficiently to decrease the resistance of the softenable material to migration of agglomerable migration marking material.

14. The imaging process of Claim 13 wherein the heat development is continued to a temperature sufficient to agglomerate the migrated agglomerable migration marking material whereby the migrated agglomerable migration marking material agglomerates and/or fuses, while the unmigrated agglomerable migration marking material remains substantially intact in its initial position contacting the gelatin layer - softenable layer interface.

15. The imaging process of Claim 14 wherein the imaging member is provided with a second substantially transparent overlayer of material overlying the layer of gelatin.

16. The imaging process of claim 14 wherein the layer of gelatin comprises a layer with a thickness of from about 0.01 to about 1.0 microns of photographic grade gelatin with a molecular weight ranging from about 20,000 to about 100,000.

* * * * *